US006105722A

United States Patent [19]

Taylor

[11] Patent Number: 6,105,722

[45] Date of Patent: Aug. 22, 2000

[54] LADDER SAFETY DEVICE

[75] Inventor: David Taylor, Normanton, United Kingdom

[73] Assignee: Brian Wilson and Melvyn Allan, United Kingdom

[21] Appl. No.: 09/056,561

[22] Filed: Apr. 7, 1998

[30] Foreign Application Priority Data

Apr. 10, 1997 [GB] United Kingdom ..... 9707282

[51] Int. Cl.[7] ..... E06C 1/00; E04G 5/02

[52] U.S. Cl. ..... 182/180.2; 182/107

[58] Field of Search ..... 182/107, 180.1–180.3, 182/200

[56] References Cited

U.S. PATENT DOCUMENTS 840,365 1/1907 Pease ..... 182/107

4,369,860 1/1983 Beane ..... 182/107 X 4,971,167 11/1990 Winnard ..... 182/107

*Primary Examiner*—Daniel P. Stodola

*Assistant Examiner*—Hugh B. Thompson

*Attorney, Agent, or Firm*—Woodard, Emhardt, Naughton, Moriarty & McNett

[57] ABSTRACT

A device for use in stabilizing the position of a ladder on a surface when in an in use position. The device comprises a series of members which engaged at a plurality of locations on the ladder rungs so as to effect a movement of the center of the gravity towards the wall or other vertical structure against which the ladder is leant. The device can be collapsible to enable the same to be stored and moved more easily from site to site.

9 Claims, 5 Drawing Sheets

VIEW ON ARROW A

VIEW ON ARROW B

LADDER SAFETY DEVICE

The invention which is the subject of this application relates to a safety device for use in conjunction with ladders. The device is provided to maintain the ladder in a secure position in relation to the surface upon which the same is placed, thus providing safety to the person on the ladder by preventing the same from slipping during the climbing of the ladder and when the person has reached the required height.

Many accidents each year are caused by ladders which, although they may appear to be stationary and securely held in position, are susceptible to slipping once the person starts to climb and generally move about on the same. Increasingly stringent safety requirements are now leading to a need for additional anchoring or securing means to be provided to prevent the ladder from being free to slip during use. One known solution is to provide a mechanical linkage which is connected to the ladder permanently and which can be moved to a position when the ladder is in the required position for use to provide additional legs in contact with the support surface. However, the disadvantage with this type of system is that it is required to be permanently fixed to the ladder and, when one considers that, for example, a window cleaner will have 3 or 4 different sizes of ladder for different purposes, it can become expensive to provide a safety device of this type for each ladder as would be required.

An alternative solution is to provide anchoring points on the building to which said ladder can be anchored but again the practicality of this is limited as it restricts the positions at which the ladder may be used and, as one of the benefits of ladders is that they allow access to areas which otherwise would not be accessible this solution is not practical as it does not provide the required flexibility.

The aim of the present invention is to provide a device for use in safely locating ladders in a position for use and to provide a device which can be used in conjunction with the ladder but is not restricted for use with a particular ladder or in relation to a particular location of the ladder.

In a first aspect of the invention there is provided a device comprises first and second members, each of said members having a point of contact with the ladder and a point of contact with the surface upon which the ladder is placed so as to locate with the ladder at a plurality of location points and stabilise the ladder in position with respect to the surface.

Typically the first and second members are spaced and locate with the ladder at first and second positions on the ladder. In one particular embodiment there are provided third and fourth members, connected to said first and second members respectively and which are locatable with the ladder to provide at least four location points with the ladder.

In one preferred embodiment, the third and fourth members are longer than the space between adjacent rungs, thus preventing the device from sliding through the space between adjacent rungs when in use.

The device can, in one embodiment, comprise first and second members respectively for contact with the rungs, typically first or second rungs from the bottom, of the ladder and third and fourth members lying perpendicularly to the first and second members for contact with at least an additional rung of the ladder. Typically there is provided at least one joining member which connects the first and third members to the second and fourth members and maintains the same in a spaced relationship. In one preferred embodiment the device is collapsible for storage with a first part comprising said first and third members, a second part comprising the second and fourth members and the joining members being separable. The joining member passes between said first and second parts and serves to maintain said first and second parts in an erected form and in contact with the ladder during use, thereby maintaining the device for location of the ladder.

In this form it is envisaged that the joining member is adjustable with respect to the first and second parts so as to allow the spacing between the first and second parts to be adjustable to contact the vertical members of the ladder within a given range. This form of the device also provides the advantage of allowing the same to be easily assembled, used, disassembled and moved to the new ladder position and the device does not provide significant additional weight or, more importantly, require further additional storage space when not in use.

The provision of four contact points between the device and ladder acts to reduce and dissipate the forces acting on the ladder which can encourage the same to slip. The redirection of the forces by the device into the wall against which the ladder is leaning acts to greatly improve the safe use of the same.

In one embodiment there is provided a device for use in stabilising a ladder, said device collapsible and erectable between storage and in use positions and, when formed, comprising a series of members joined together, including first and second members locatable with at least a first rung of the said ladder, and at least one of said members in contact with the surface upon which the ladder is supported, so as to locate and secure the ladder in position with respect to the surface, and third and fourth members to locate with another rung of the ladder to provide four location points of the device with the said ladder.

The device according to one embodiment of the invention is now described with reference to FIGS. 1 to 8, wherein.

Figure 1:
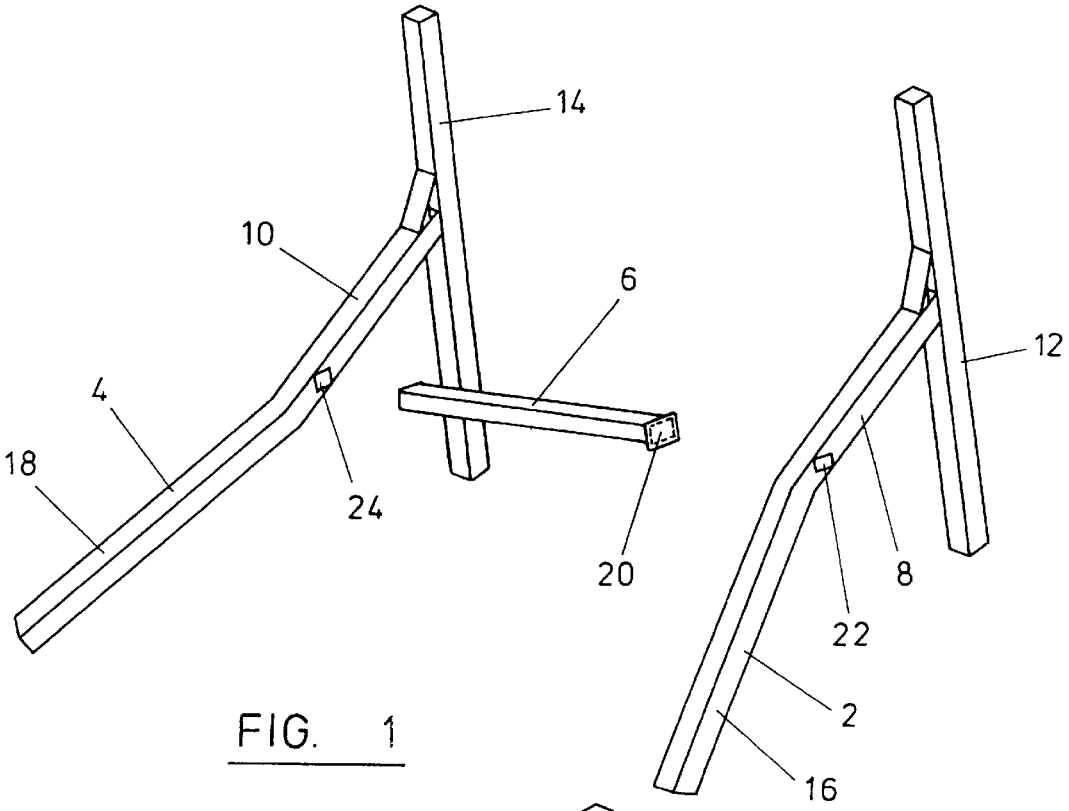
FIG. 1 illustrates the parts of the device in a disassembled condition.

Referring firstly to FIG. 1 there is illustrated a device according to the invention which comprises a first part 2, second part 4 and joining member 6. The first and second parts each comprise a first or second, location member 8, 10 with, at one end thereof third and fourth members 12, 14 respectively, and at the other end angled portions 16, 18 respectively. It will be seen that the portions 16, 18 are angled with respect to the remaining members of the respective first and second parts.

The joining member 6 is provided in the form of a bar with a stop 20 at one end and said joining member is slidably locatable in apertures 22, 24 in the first and second parts respectively to form the device into an erected position and maintain the first and second parts in the erected position.

Figure 2:
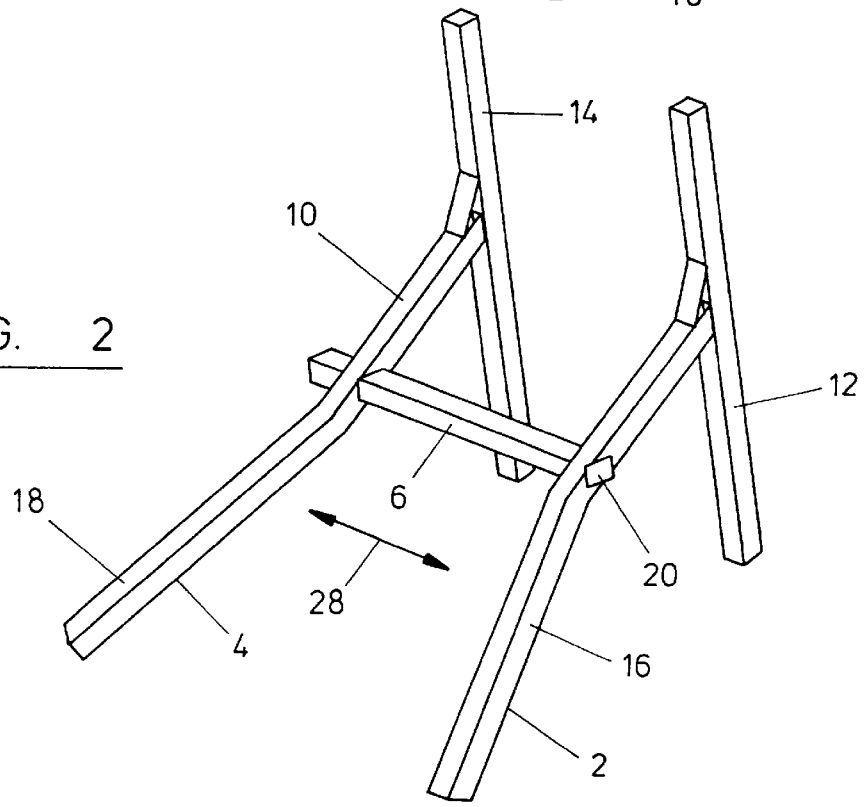
FIG. 2 illustrates the device in an assembled condition.

The device is shown in an erected position in FIG. 2 where it will be seen that the first and second parts are held in an upstanding position. The distance between the first and second members is adjustable as indicated by the arrow 28 by moving one of the parts away or towards the other by sliding the same along the joining member 6.

Figure 3:
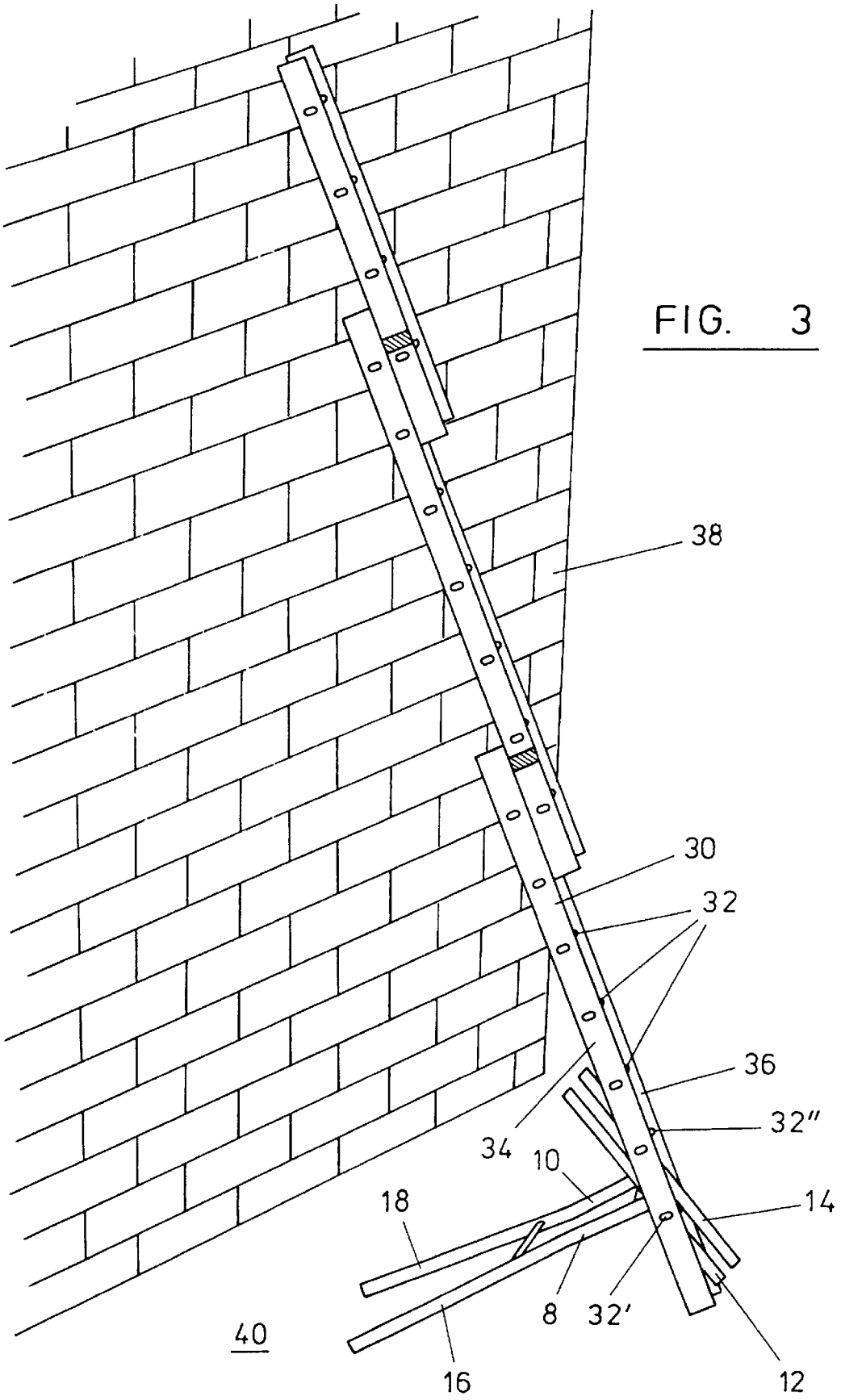
FIG. 3 illustrates the device in use in conjunction with a ladder.

The device in use is shown in FIG. 3 wherein there is shown a ladder 30 with rungs 32 and vertical members 34, 36 spaced apart by the rungs 32. The ladder is shown in relation to a building 38 and support surface 40 and also shown is the device of the invention located with the ladder. In the in-use position the location members 8, 10 of the first and second parts of the device locate with the internal faces of the vertical members 34, 36 as shown and the ends of the portions members 16, 18 contact with the support surface as shown so as to locate the ladder in a fixed position. The members 8,10,12 and 14 each locate with the rungs 32' or 32" so as to provide at least four contact points with the device and ladder rungs. The members 12, 14 are shown to be longer than the space between adjacent rungs 32', 32" and thereby prevent the device from slipping through the space between the rungs in use.

Figure 4A:
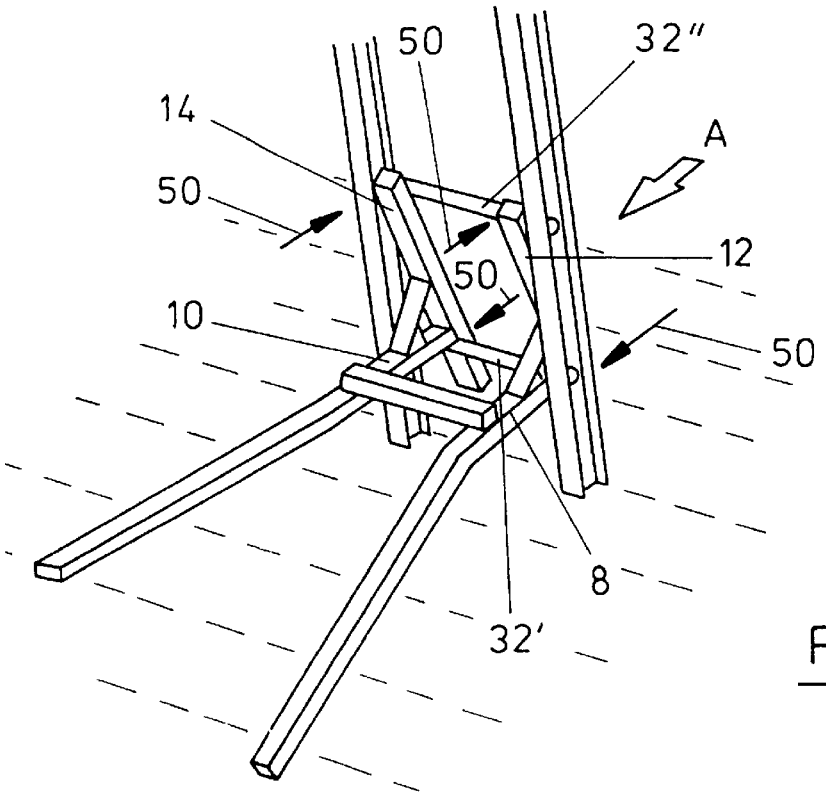
FIGS. 4A and 4B illustrate the device in use with a ladder.
Figure 4B:
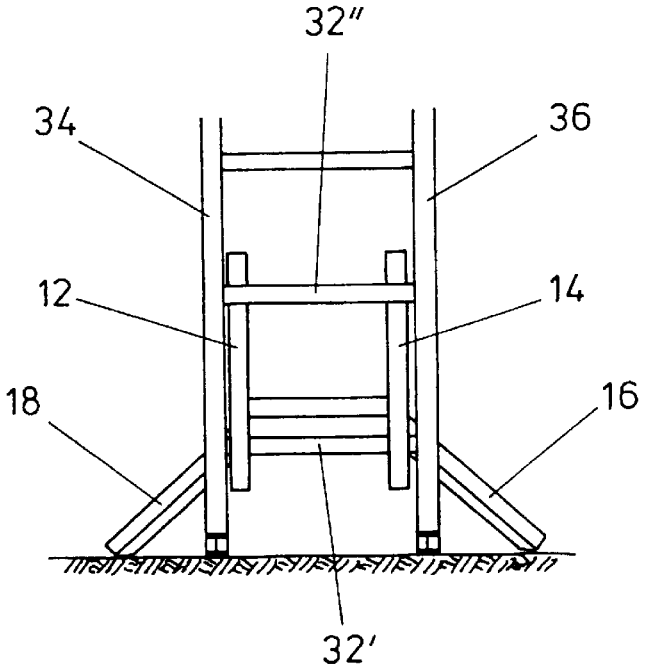

Thus, to use the device according to the invention, the device, which is in a disassembled form, is formed by placing the first and second parts in the required position for use and then placing the joining member 6 through the apertures in the first and second parts. The device can then be positioned with the ladder with the members 8. 10 placed through the aperture defined between adjacent rungs 32, typically the first and second rungs 32' , 32" and vertical members 34, 36, and then sliding the first and second parts apart until they preferably contact with the vertical members 34, 36. The location members 8, 10, can then locate with the rung 32' of the ladder and the members 12, 14 locate with the rung 32" of the ladder thereby providing at least four contact points between the device and the ladder. A check that there are four points of contact between the device and that the members 8–14 are in contact with the rungs of the ladder is made. The device in an in use position is also shown in FIGS. 4A and 4B where the contact points between the device and the rungs 32 are indicated by arrows 50.

Figure 5:
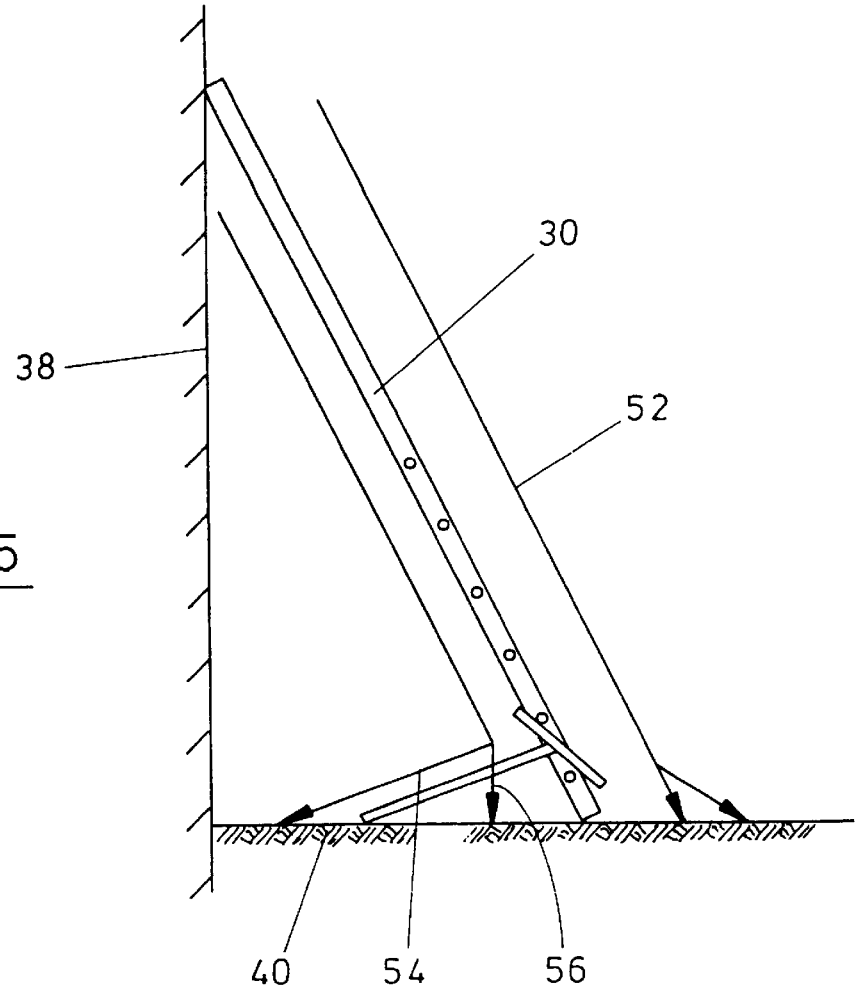
FIG. 5 illustrates in a schematic fashion the forces acting on the ladder without and with the device of the invention.
Figure 6:
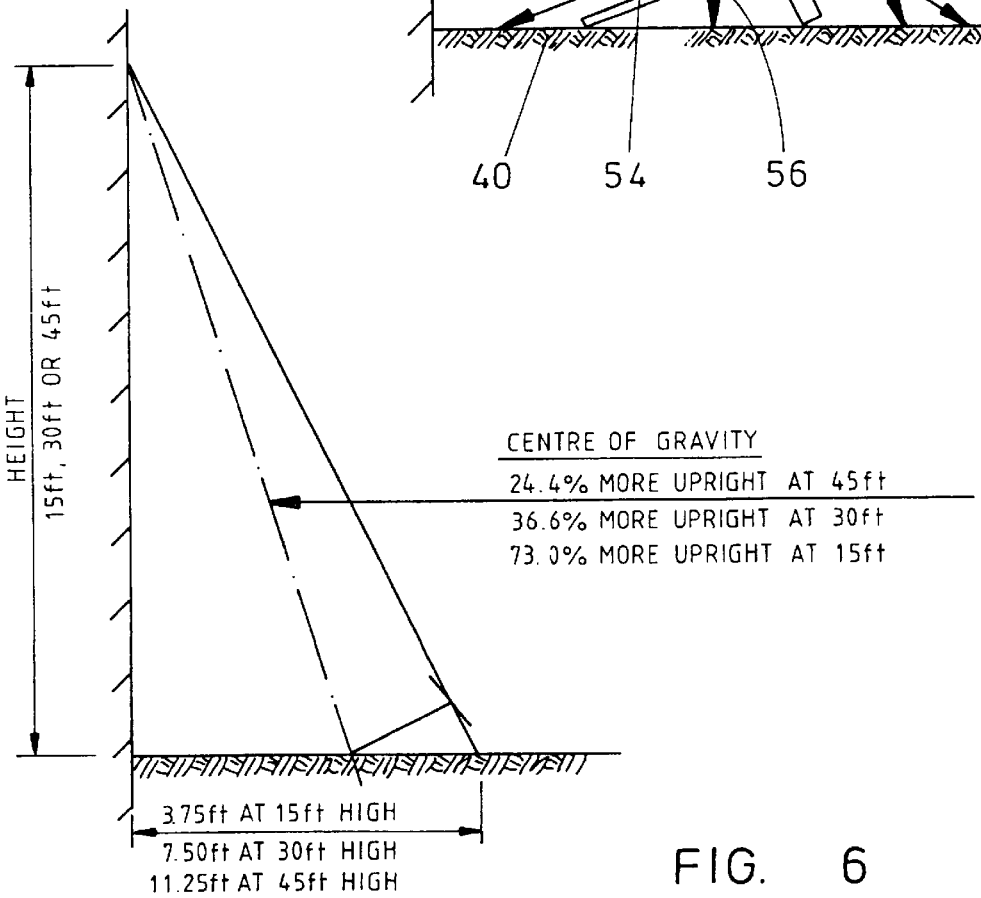
FIG. 6 illustrates the effect on the centre of gravity of the ladder when the device is used.

The principle of operation of the device is based on the fact that a ladder which is leaning against a wall forms a geometrical triangle with the wall and support surface which is known to be a strong shape for a structure. The device of this invention, when used in conjunction with the ladder, effectively creates a geometrical triangle within the first triangle and thereby increases the strength of the structure formed, Referring to FIG. 5, the wall 38, support surface 40 and ladder 30 are shown in side view. Without the device of the invention the line of forces applied on the ladder is shown and indicated by the numeral 52 and as can be appreciated the application of the force at the angle illustrated can be such as to encourage the ladder to slip in relation to the surface 40 and also wall 38. However when the device is used and fitted as shown to the ladder so the effect of the force adjacent the surface is altered as indicated by arrows 54, 56 and diverts part of the usual downward force, through the members of the device towards the wall 38 thus creating an opposing force to that indicated by arrow 52 and hence preventing slip of the ladder. The device therefore allows the centre of gravity of the ladder to be moved towards the wall as is illustrated in FIG. 6 and so allowing the ladder in use to act as if it is more upright than it actually is and this is achieved by the device and the four points of contact with the ladder rungs.

Figure 8A:
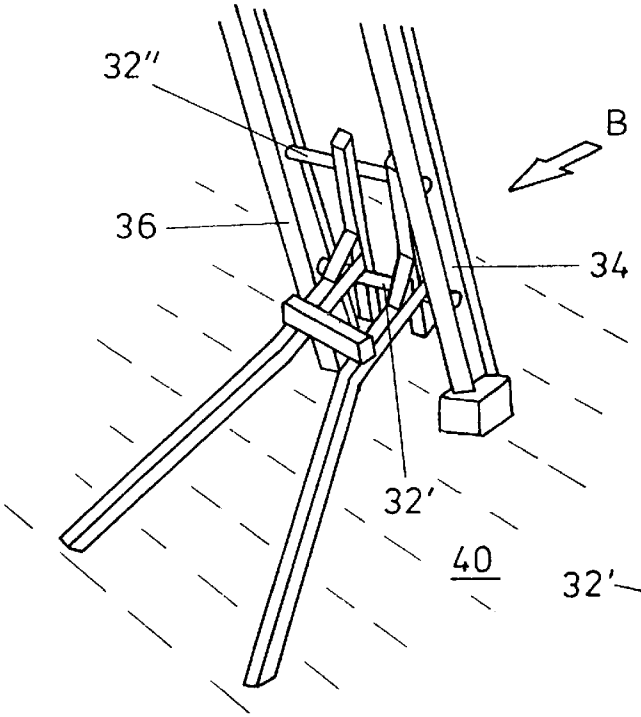
FIGS. 7, 8A and 8B illustrate the device in use on a sloping surface.
Figure 8B:
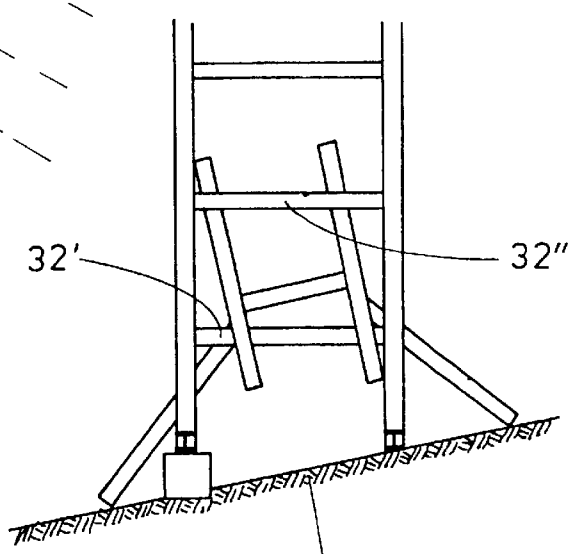
Figure 7:
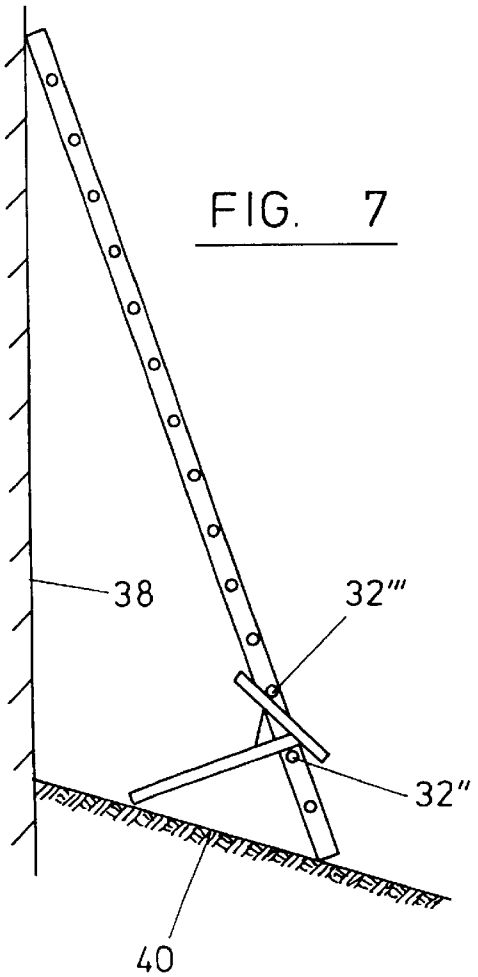

The device is also of use when the support surface is not flat when the device may be used in the manner shown in FIGS. 7 and 8. If the surface is as shown in FIG. 7 the device is installed between, and to contact with, the second and third rungs 32", 32'". If the surface is as shown in FIGS. 8A and 8B the ladder should be levelled in a safe manner and then, instead of extending the first and second parts of the device to the full width of the ladder, the first and second parts are moved apart to a lesser distance and the device is twisted as shown to accommodate the slope but care should be taken to ensure that there are still four contact points with the first and second rungs 32', 32".

Thus it will be seen that the device according to the invention is simple to use, can be easily stored, and provides safety in use. The device prevents outward slip of the ladder when used in the proper manner and in tests it has been shown to be better and safer than other anchoring means for ladders. The device also acts to remove the bounce which can occur during movement along the ladder therefore making it feel more secure and act as a fixed ladder. Primarily however, the device provides an additional two contact points between the surface and the ladder thus forming in conjunction with the ladder a 2 dimensional base which has the shape of a trapezium which enhances sideways stability and prevents slip of the ladder while at the same time ensuring that the ladder is set at substantially the correct angle.

What is claimed is:

1. A ladder combination erectable on a support surface and leanable against a wall comprising:

a ladder having vertical members and further having an upper rung and a lower rung spaced apart a first distance, said ladder having a bottom restable upon a support surface;

first and second members with proximal ends and distal ends, said distal ends spaced apart from said bottom of said ladder but restable upon said support surface to stabilize said ladder upon said support surface;

third and fourth members with top end portions and bottom end portions, said proximal ends of said first and second members mounted to said third and fourth members between said top end portions and said bottom end portions with said proximal ends spaced apart from said support surface, said third and fourth members having lengths greater than said first distance with said third and fourth members removably extending between said upper rung and said lower rung, said top end portions contacting said upper rung at first and second locations and said proximal ends of said first and second members resting upon said lower rung at third and fourth locations; and, a joining member adjustably mounted to and controllably spacing apart said first and second members.

2. The ladder combination according to claim 1 wherein said third and fourth members are connected to said first and second members respectively and which are locatable with the ladder to provide, in conjunction with said first and second members at least four location points with the ladder.

3. The ladder combination according to claim 2 wherein said third and fourth members lie perpendicularly to the said first and second members with said first and second members arranged to contact said lower rung of said ladder and third and fourth members arranged to contact said upper rung.

4. The ladder combination according to claim 2 wherein said joining member maintains the first and third members spaced from the second and fourth members.

5. The ladder combination according to claim 4 wherein said first and third members form a first part and said second and fourth members form a second part and the joining member is separable therefrom.

6. The ladder combination according to claim 5 wherein the joining member is adjustable with respect to the first and second part so as to allow the spacing between the first and second part to be adjustable to contact said vertical members of the ladder within a given range.

7. The ladder combination according to claim 1 wherein the first and second members include distal end portions which contact the support surface with said distal end portions diverging outwardly to improve stability of the ladder.

8. The ladder combination of claim 1 wherein:

said ladder has a top contactable against a wall, said first and second members extend from said ladder toward said wall with said distal ends located between said bottom of said ladder and said wall.

9. A ladder combination erectable on a support surface and leanable against a wall comprising:

a ladder having vertical members and further having an upper rung and an adjacent lower rung spaced apart a first distance, said ladder having a bottom restable upon a support surface;

a support including first and second members with proximal ends and distal ends, said distal ends spaced apart from said bottom of said ladder but restable upon said support surface to stabilize said ladder upon said support surface;

said support further including third and fourth members with top end portions and bottom end portions, said proximal ends of said first and second members mounted to said third and fourth members between said top end portions and said bottom end portions with said proximal ends spaced apart from said support surface, said third and fourth members having lengths greater than said first distance with said third and fourth members removably extending between said upper rung and said lower rung, said proximal ends of said first and second members resting on the lower rung and said third and fourth members contacting said upper rung providing at least four contact points between said support and said ladder; and, a joining member adjustably mounted to and controllably spacing apart said first and second members.

* * * * *